US005107987A

United States Patent [19]

Palazzolo et al.

[11] Patent Number: 5,107,987

[45] Date of Patent: Apr. 28, 1992

[54] TOOTHBRUSH HOLDER

[76] Inventors: Frank J. Palazzolo, 20211 Van Antwerp, Harper Woods, Mich. 48225; Joel L. Stone, 1317 Lakepointe Rd., Grosse Pointe Park, Mich. 48230

[21] Appl. No.: 522,650

[22] Filed: May 14, 1990

Related U.S. Application Data

[63] Continuation-in-part of Ser. No. 272,869, Nov. 18, 1988.

[51] Int. Cl.[5] ..... B65D 81/00

[52] U.S. Cl. ..... 206/209.1; 206/362.1

[58] Field of Search ..... 206/209, 209.1, 361, 206/362, 362.1, 362.2

[56] References Cited

U.S. PATENT DOCUMENTS

| | | | |
|---|---|---|---|
| 1,084,965 | 1/1914 | Roberts | 206/209.1 X |
| 1,102,284 | 7/1914 | Miller | 206/209.1 X |
| 1,138,523 | 5/1915 | Withycombe | 206/209.1 |
| 1,562,348 | 11/1925 | Lockery | 206/209.1 |
| 2,195,935 | 4/1940 | Nuyts | 206/209.1 |
| 3,904,362 | 9/1975 | Di Paolo | 206/209.1 |
| 4,113,090 | 9/1978 | Carstens | 206/306 X |
| 4,214,657 | 7/1980 | Winston | 206/209.1 |
| 4,473,152 | 9/1984 | Jump, Jr. et al. | 206/209.1 |
| 4,915,219 | 4/1990 | Ottimo | 206/209.1 |

*Primary Examiner*—Paul T. Sewell
*Assistant Examiner*—Jacob K. Ackun, Jr.
*Attorney, Agent, or Firm*—John R. Benefiel

[57] ABSTRACT

A toothbrush holder having a main container 10, a lid 14, and internal separators 15. The toothbrush main container contains disinfectant 11 in the form of a mouthwash. The container forms a chamber with the disinfectant acting as an immersion agent for loosening materials from a toothbrush. The bottom of the container has a plurality of protrusion support elements 19 which are spaced apart from one another and support a toothbrush dropped into the disinfectant spaced above the bottom of the main container so as to provide trap space for foreign material carried by said toothbrush.

5 Claims, 2 Drawing Sheets

TOOTHBRUSH HOLDER

RELATED APPLICATIONS

This application is a continuation in part of U.S. Ser. No. 07/272,869 filed Nov. 18, 1988 and entitled "Individual Dental Utensil Lock".

BACKGROUND OF THE INVENTION

This invention relates to a toothbrush holder, and more particularly to a container for holding a toothbrush and a toothbrush disinfectant.

Toothbrushes are generally sold in a container designed to hold one toothbrush, usually with a cap to retain the toothbrush in the container. It is the general practice to open this container and discard it, placing the toothbrush in a medicine cabinet or in a wall holder adjacent the washbasin where the owner brushes his teeth.

In such an environment the toothbrush collects bacteria and other "germs" or viruses of the household as well as the user. The toothbrush itself is wet after use, and provides a breeding ground for these elements. The present application is designed as a container for toothbrushes which provides better hygiene.

SUMMARY OF THE INVENTION

The invention described comprises a container for use with a toothbrush or a plurality of toothbrushes which can be set on a sink or wall mounted and which can be economically manufactured by plastic processing techniques; including plastic injection molding. It provides a dust resistant cover which can be placed on the a main container when the container houses the toothbrush instruments to form a disinfectant chamber. The main container is provided with a main chamber which is designed to house replaceable disinfectant which is hygienically appropriate as a mouthwash and disinfectant. The main container suspends the toothbrush instruments contained within the main container above the bottom of the container while the instruments are being soaked and disinfected by means of vertically extending ridges or prongs extending upwardly from the bottom of the container.

A more detailed understanding of the various features of the inventions described herein will be had by review of the following description and drawings in which.

DETAILED DESCRIPTION

Turning to the drawings now in greater detail it should be appreciated that the concept of the invention implemented by the detailed embodiment described herein is to change the pattern of toothbrush maintenance and to provide a hygienically improved toothbrush maintenance chamber in which one or more toothbrushes are housed within a main container 10 immersed within an immersion agent in the form of a mouth-wash disinfectant 11 contained therein. Thus, departing from the general practice of placing the toothbrush in a medicine cabinet or in a wall holder (which also holds a cup) adjacent to a washbasin, the owner will now store his toothbrush (illustrated schematically at 12) between uses in the described container 10 with the brush 12 end immersed within mouthwash disinfectant 11. The preferred mouthwash disinfectant 11 is Listerine (a trademark and well known brand name) or another disinfecting mouthwash.

This mouthwash is effective for killing or reducing the replication of bacteria and other molds and fungi which could be on the toothbrush 12. The present application is designed as a container 10 for the toothbrush which in conjunction with the mouthwash provides for better oral hygiene.

Figure 1:
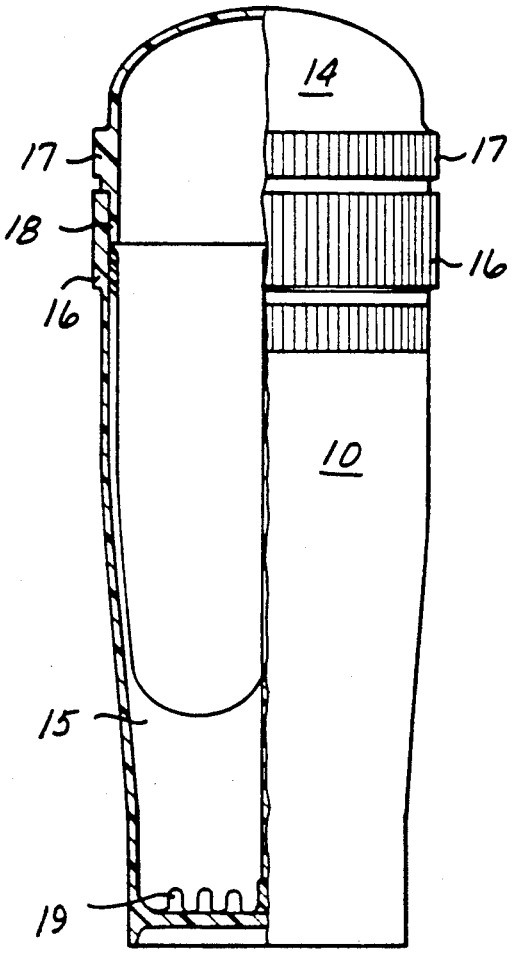
FIG. 1 is a partially cutaway side view of the container.

The container 10 illustrated in FIG. 1 in the preferred embodiment is generally cylindrical. In the preferred embodiment, there are a total of six parts to the container 10. The lid is one portion. The main container 10 is a second portion, and the third through the sixth portions are separators 15 each one for a toothbrush. Thus the unit is designed to house four toothbrushes.

The main container 10 portion has a cylindrical shape which is tapered to be narrower at the bottom end. A collar flange 16 is provided at the top of the mouthwash container 10 to extend outwardly to form a flange 16 to hold the unit in a wall mounted support bracket, into which it can be inserted. In addition, the container 10 can sit on the counter adjacent to the washbasin. The container 10 portion is in the preferred embodiment three inches in diameter, and the collar flange 16 is ¾ inch high, and has a grip with vertically directed spaced indentations extending around the outer periphery of the collar. The bracket flange 16 lip is approximately 80/100oth of an inch. The overall thickness of the main unit is 60/100th of an inch, and the main container 10 unit is preferably between six and seven inches high and in the most preferred embodiment illustrated is 6 and 7/32" high. The main container 10 unit tapers to a smaller diameter preferably beginning about 3 and 5/16 of an inch from the bottom and then straightens to be cylindrical again at about 1 inch from the bottom. The main container 10 is provided with a ring base which supports a ⅛th inch thick bottom wall of the container 10 located ⅛th inch above the bottom edge of the mouthwash container 10.

Figure 2:
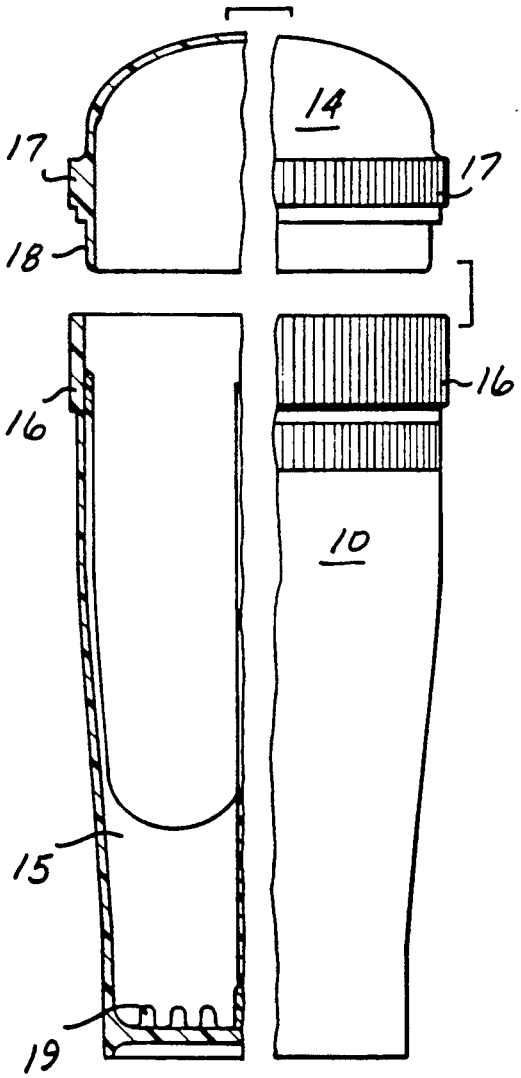
FIG. 2 is another cutaway view of the container of FIG. 1, and shown in two parts.
Figure 3A:
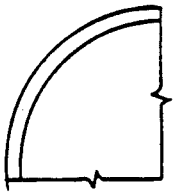
FIGS. 3A and 3B are top overviews looking down on the container cap or lid, with quarter sections showing the lid exterior 3A, the lid interior 3B, the main container bottom 3C, and the container interior 3D.
Figure 3B:
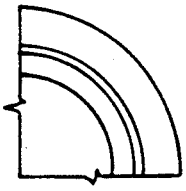
Figure 3D:
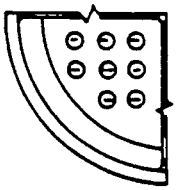
Figure 3C:
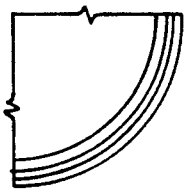
Figure 4:
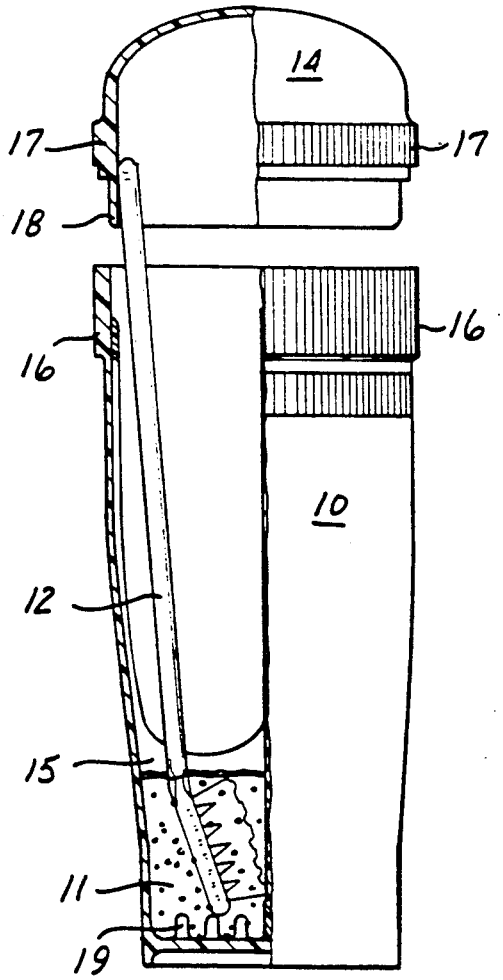
FIG. 4 is a side view of the main disinfectant container similar to FIG. A, also showing above the main container the lid of the container removed from the main disinfectant container.

The base wall of the container 10 is provided with protrusive finger supports, in the form of fingers, prongs or ridges, preferably shaped in the form of the preferred protrusive support fingers shown in FIG. 2. The protrusive support fingers are approximately ¼ inch high and spaced at ¼ inch intervals across the bottom of the container 10. They are approximately ⅛ inch in diameter. These protrusive support fingers or elements allow foreign material removed by the fluid disinfectant 11 to fall and be trapped at the bottom of the container chamber.

The main container 10 mates with the lid 14 of the container. This lid 14 has an elliptically shaped dome, and is generally cylindrical to mate with the main container 10. While in the preferred embodiment, the lid 14 joins the main container 10 with a press slip fit. Alternatively, the lid 14 may be joined to the main container 10 by making mating threads (not shown in the preferred embodiment) on the lid 14 and main container 10. A screw fit will be preferred in the event that the container 10 has fluid provided with it at the point of sale.

The lid 14, like the main container 10, is provided with a flange grip. In the preferred embodiment the lid 14 is three inches in diameter, with the lid 14 collar grip 17 being at a ⅜th inch high portion being provided with a grip formed of striated vertical anti-slip ridges at a spacing of 14 ridges or indentations per inch so as to form vertically directed spaced grips or indentations extending around the outer periphery of the grip collar of the lid. The grip collar of the lid 17, then has a mating lip 18 for the main container 10 which mates inside the top of the main container 10 when the lid 14 is joined to the main container 10 abutting the collar, and the lid 14 is thus provided with a cylindrical press lip (or alternatively threaded lip) which mates with the collar flange of the main compartment. In the preferred embodiment, this lip of the lid is positioned so as to be inserted internally within the collar flange 16 of the main container 10. Accordingly, it will be appreciated that all parts of the container 10 can be manufactured by plastic processing techniques, including plastic injection molding. The preferred embodiment of the invention is made of clear polyethylene. The lid 14 provides a dust resistant cover which can be placed on the a main container 10 when the container 10 houses the toothbrush 12 utensils.

The main container 10 provides a main chamber which is designed to house replaceable disinfectant 11 which is hygienically appropriate, disinfectant being either a mouthwash of other suitable oral disinfectant 11. The combination of the mouthwash in the main container 10 with the main container 10 suspends the toothbrush 12 instruments contained within the main container 10 above the bottom of the container 10 but within the mouthwash by partially filling the container 10 with mouthwash to soaked and disinfect a toothbrush 12 suspended above the bottom of the main container 10 by the vertically extending protrusive support 19 fingers, ridges or prongs (elements) extending upwardly from the bottom of the container 10.

Four separators 15 are provided in the preferred embodiment. Each separator 15 is adapted to contain a single toothbrush 12 and function as an individual toothbrush 12 compartment. While four separators are preferably made as four separate units, the separators 15 could be made as four compartments of a single insertable toothbrush 12 holding compartment insert having four holding separator 15 parts Each separator 15 is a plastic molded insert. The separator 15 insert for the toothbrush 12 holder is open at the top and bottom. The top of the separator 15 allows the toothbrush 12 to rest on the protrusive finger supports 19.

In use the main container 10 is filled with mouthwash to a point where the brush portion of a toothbrush 12 will be covered by the preferred mouthwash disinfectant. The separators are in place at the time the toothbrushes are inserted. The mouthwash functions to loosen any remaining materials on the toothbrush 12, and kill the "germs", the materials then fall away from the toothbrush down to the bottom and rest within the chamber trap space defined by the top of said protrusive support elements 19 (the fingers, prongs or ridges) and the bottom floor of said main container.

While we have described our preferred embodiment, our inventions are not so limited, and the following claims are intended to define the scope of our invention without departing from the spirit of our inventions.

We claim:

1. A toothbrush container for one or more toothbrushes comprising:

a main container having side walls and a bottom defining an internal chamber therein with side walls and a bottom end, said container having an open top, a lid for said main container, said lid being sized to mate with the top of said main container, said lid and said main container being configured with lip and sleeve means for securing the lid to said main container and for enclosing the same to form a container with a sealed chamber therein, a plurality of separators each sized to hold a toothbrush housed within said main containers, said separators being formed so as to provide an open top end into which said toothbrush may be inserted and an open bottom end to permit said toothbrush to drop to said bottom end of said main container, said bottom end of said main container having a plurality of vertically upwardly projecting protrusive fingers collectively adapted to contact and support the brush end of a toothbrush and hold the toothbrush above and spaced away from the bottom of said main container, said plurality of upwardly projecting support protrusive fingers being spaced from one another and of small diameter so as to permit materials loosened from said toothbrush to drop to the bottom of said main container and to maintain said toothbrush above said loosened materials in a trap space beneath the top of said upwardly projecting protrusive fingers.

2. A toothbrush holder according to claim 1, further comprising, fluid disinfectant located at the bottom of the chamber which is filled with said fluid disinfectant up to a point where a toothbrush dropped down onto said protrusive support elements will be partially immersed in said fluid disinfectant.

3. A toothbrush holder according to claim 1 wherein said main container has a collar flange at the upper end thereof around the side wall of said container, said collar flange having a plurality of striated indentations formed therein for a gripping surface, and said flange extending outwardly from said side wall so as to form at the bottom of said collar flange a support stop.

4. The toothbrush container of claim 1 wherein said main container has a height between six and seven inches and has a diameter between two and one half inches and three and one half inches.

5. The toothbrush holder according to claim 1 wherein said separators are a plurality of individual pie shaped sleeves open at the top and the bottom and insertable into said main container.

* * * * *